United States Patent [19]

Cullinan et al.

[11] Patent Number: 4,960,682

[45] Date of Patent: Oct. 2, 1990

[54] BLEACHING COMPOSITIONS CONTAINING A DYE-STABILIZING AGENT AND USE THEREOF IN PHOTOGRAPHIC COLOR PROCESSING

[75] Inventors: Ann M. Cullinan, Henrietta; Paul A. Schwartz, Webster, both of N.Y.

[73] Assignee: Eastman Kodak Company, Rochester, N.Y.

[21] Appl. No.: 286,111

[22] Filed: Dec. 19, 1988

[51] Int. Cl.[5] ..... G03C 5/58; G03C 5/44

[52] U.S. Cl. ..... 430/393; 430/407; 430/430; 430/460; 430/461

[58] Field of Search ..... 430/393, 430, 460, 461, 430/407, 379

[56] References Cited

U.S. PATENT DOCUMENTS

| | | | |
|---|---|---|---|
| 2,476,544 | 3/1949 | Harsh et al. | 95/88 |
| 3,667,950 | 4/1972 | Amano et al. | 96/60 |
| 3,879,202 | 9/1975 | Yamaguchi | 96/22 |
| 3,948,659 | 4/1976 | Yamaguchi et al. | 430/393 |
| 4,033,771 | 10/1977 | Borton et al. | 96/60 |
| 4,124,398 | 11/1978 | Ciurla, Jr. et al. | 430/393 |
| 4,125,402 | 7/1978 | Mollet | 96/53 |
| 4,293,639 | 10/1981 | Itoh et al. | 430/393 |
| 4,506,007 | 3/1985 | Nakajima et al. | 430/393 |
| 4,554,242 | 11/1985 | Ohno et al. | 430/393 |
| 4,578,345 | 3/1986 | Ohno et al. | 430/393 |
| 4,605,611 | 8/1986 | Ohno et al. | 430/393 |
| 4,786,583 | 11/1988 | Schwartz | 430/372 |
| 4,839,262 | 6/1989 | Schwartz | 430/379 |

*Primary Examiner*—Paul R. Michl
*Assistant Examiner*—Patrick A. Doody
*Attorney, Agent, or Firm*—Alfred P. Lorenzo

[57] ABSTRACT

Improved photographic bleaching compositions for use in the color processing of photographic elements comprise an aqueous solution containing a photographic bleaching agent, such as, for example, an ammonium or alkali metal salt of a ferric complex of an aminopolycarboxylic acid, and a dye-stabilizing amount of a formaldehyde percursor.

4 Claims, No Drawings

BLEACHING COMPOSITIONS CONTAINING A DYE-STABILIZING AGENT AND USE THEREOF IN PHOTOGRAPHIC COLOR PROCESSING

FIELD OF THE INVENTION

This invention relates in general to photography and in particular to compositions for the bleaching of photographic elements. More specifically, this invention relates to novel photographic bleaching compositions which are useful in the color processing of photographic elements and which contain both a bleaching agent and a dye-stabilizing agent.

BACKGROUND OF THE INVENTION

In the production of color photographic images, it is necessary to remove the silver image which is formed coincident with the dye image. This can be done by oxidizing the silver by means of a suitable oxidizing agent, commonly referred to as a bleaching agent, in the presence of halide ion, followed by dissolving the silver halide so formed in a silver halide solvent, commonly referred to as a fixing agent. Alternatively, the bleaching agent and fixing agent can be combined in a bleach-fixing solution and the silver removed in one step by use of such solution.

A wide variety of bleaching agents are known for use in photographic processing, for example, ferricyanide bleaching agents, persulfate bleaching agents, dichromate bleaching agents, permanganate bleaching agents, ferric chloride, and water-soluble quinones.

It is particularly well known to use a ferric complex of an aminopolycarboxylic acid as a bleaching agent in photographic color processing. Such complexes are used in both bleaching compositions and bleach-fixing compositions. A very large number of different compounds of the aminopolycarboxylic acid class are disclosed in the prior art as being useful photographic bleaching agents. However, the usual commercial practice is to use an ammonium or alkali metal salt of a ferric complex of ethylenediaminetetraacetic acid (EDTA) or of a ferric complex of propylenediaminetetraacetic acid (PDTA).

Among the numerous patents describing the use of ferric complexes of aminopolycarboxylic acids in bleaching and/or bleach-fixing baths are U.S. Pat. Nos. 3,241,966, 3,615,508 and 3,767,401 and British patent Nos. 1,365,453, 1,392,163, and 1,394,357.

It is well known in the photographic art to utilize a stabilizing bath as the final step in the processing of both color films and color papers. Such baths can serve to reduce stain and/or enhance dye stability. A wide variety of different stabilizing compositions have been proposed for such use. Thus, the known stabilizing baths include those containing thiourea or a substituted thiourea as described in Kellog, U.S. Pat. No. 2,487,446 issued Nov. 8, 1949; aliphatic aldehydes as described in Harsh et al, U.S. Pat. No. 2,518,686 issued Aug. 15, 1950; addition products of formaldehyde and a urea, as described in Mackey, U.S. Pat. No. 2,579,435 issued Dec. 18, 1951; tetramethylol cyclic alcohols or ketones as described in Clarke et al, U.S. Pat. No. 2,983,607 issued May 9, 1961; glucoheptonates as described in Bard, U.S. Pat. No. 3,157,504 issued Nov. 17, 1964; carbohydrazides as described in Larson, U.S. Pat. No. 3,201,244, issued Aug. 17, 1965; amino acids as described in Jeffreys, U.S. Pat. No. 3,291,606 issued Dec. 13, 1966; mixtures of an aldehyde and an alkoxy-substituted polyoxyethylene compound as described in Seemann et al, U.S. Pat. No. 3,369,896 issued Feb. 20, 1968; compounds comprising a tri(hydroxymethyl)-methyl group as described in Jeffreys et al, U.S. Pat. No. 3,473,929 issued Oct. 21, 1969; and addition complexes of an alkali metal bisulfite and an aldehyde as described in Mowrey, U.S. Pat. No. 3,676,136 issued July 11, 1972. The use of more than one active agent in such stabilizing baths is also known. For example, U.S. Pat. No. 3,676,136 to Mowrey describes the use of antioxidants such as glucose, galactose, sorbitol or mannitol in a stabilizing bath in addition to an aldehyde bisulfite addition complex.

Magenta dye stability is a particularly serious problem in color photography, as the magenta dye image tends to fade much more rapidly than either the cyan dye image or the yellow dye image. The dark-keeping stability of magenta image dyes derived from pyrazolone couplers is adversely affected by the presence of the coupler itself. This is particularly evident in the toe and midscale regions of the green sensitometric curve. In these areas, there is a substantial amount of the unreacted coupler. This unreacted coupler undergoes complex chemical reactions with the magenta dye.

For many years, formaldehyde has been commonly used as a stabilizing agent in photographic color processing to provide enhanced magenta dye stability. The photographic element is treated with a final bath—called a "stabilizing bath"—that contains formaldehyde. The formaldehyde reacts with the unused coupler in the film, forming a stable compound that will not react with the magenta dye. Under normal processing conditions, this reaction is completed in the drying oven. However, while formaldehyde is a very effective stabilizing agent for this purpose, its use is highly disadvantageous from an ecological standpoint because of the well known ecological concerns relating to formaldehyde.

It is toward the objective of providing an improved bleaching composition that provides effective bleaching action and also provides improved dye stability, so as to eliminate the need for a stabilizing bath, that the present invention is directed.

SUMMARY OF THE INVENTION

In accordance with this invention, photographic bleaching compositions for use in the color processing of photographic elements comprise an aqueous solution containing a photographic bleaching agent and a dye-stabilizing amount of a formaldehyde precursor.

The invention is based on the discovery that formaldehyde precursors can be incorporated in bleaching baths to provide enhanced dye stability and thereby eliminate the need for a stabilizing bath containing formaldehyde.

DESCRIPTION OF THE PREFERRED EMBODIMENTS

As indicated hereinabove, the essential components of the novel bleaching compositions of this invention are a photographic bleaching agent and a formaldehyde precursor.

The formaldehyde precursor can be used in the bleaching solution in any amount that is effective to enhance dye stability. Typically, it is employed in amounts of from about 0.1 to about 20 grams per liter of bleaching solution; and preferably in amounts of from about 2 to about 10 grams per liter.

The bleaching agent can be used in the bleaching composition in any amount that is effective to provide the desired bleaching action. Typically, amounts of from about 10 to about 400 grams per liter, and more preferably about 20 to about 150 grams per liter, are utilized. The working strength bleaching solution typically has a pH in the range of from about 5 to about 7 and preferably contains a soluble halide, such as ammonium bromide, in a concentration of at least about 50 grams per liter.

The bleaching compositions of this invention can contain other addenda known in the art to be useful in such formulations, such as amines, sulfites, mercaptotriazoles, and non-chelated salts of aminopolycarboxylic acids.

The compositions of this invention are bleaching compositions and not bleach-fixing compositions, and thus they are substantially free of fixing agents. The term "bleaching composition" as used herein is intended to exclude bleach-fixing compositions.

Bleaching agents can be used individually or in the form of mixtures of two or more bleaching agents. Exemplary bleaching agents of the aminopolycarboxylic acid type, which can be used alone or in the form of mixtures, include ferric complexes of:

nitrilotriacetic acid,
ethylenediamine tetraacetic acid,
propylenediamine tetraacetic acid,
diethylenetriamine pentaacetic acid,
ortho-diamine cyclohexane tetraacetic acid,
ethylene glycol bis(aminoethyl ether) tetraacetic acid,
diaminopropanol tetraacetic acid,
N-(2-hydroxyethyl)ethylenediamine triacetic acid,
ethyliminodipropionic acid,
iminodiacetic acid,
methyliminodiacetic acid,
ethyliminodiacetic acid,
and the like.

In some instances the use of a mixture of bleaching agents is preferred over the use of individual bleaching agents. Thus, for example, a mixture can provide a desired level of bleaching power intermediate that of the individual bleaching agents of which it is composed; it can improve the effectiveness of leuco cyan dye recovery, that is, the reoxidation of the leuco form to the colored cyan dye; it can minimize bleach-induced dye formation, that is, the formation of image dye that occurs when color developer carried by the photographic element into the bleach is oxidized to form image dye; and it can improve the effectiveness of bleach regeneration carried out by use of aeration.

Examples of particularly useful mixed bleaches include a mixture of the ferric complex of ethylenediaminetetraacetic acid and the ferric complex of propylenediaminetetraacetic acid, a mixture of the ferric complex of ethylenediaminetetraacetic acid and the ferric complex of methyliminodiacetic acid, and a mixture of the ferric complex of iminodiacetic acid and the ferric complex of methyliminodiacetic acid.

The bleaching compositions of this invention are especially useful in the color processing of photographic elements, including photographic films utilized in negative-positive processes or in color reversal processes. Useful processes include a three-step process—comprising the steps of color developing, bleaching and fixing—and a six-step process—in which the film is processed in a first developer, a reversal bath, a color developer, a conditioning bath, a bleach bath and a fixing bath. The processing is typically carried out using a color developing solution which contains a primary aromatic amino color developing agent. These color developing agents are well known and widely used in a variety of color photographic processes. They include aminophenols and p-phenylenediamines.

Examples of aminophenol developing agents include o-aminophenol, p-aminophenol, 5-amino-2-hydroxytoluene, 2-amino-3-hydroxytoluene, 2-hydroxy-3-amino-1,4-dimethylbenzene, and the like.

Particularly useful primary aromatic amino color developing agents are the p-phenylenediamines and especially the N-N-dialkyl-p-phenylenediamines in which the alkyl groups or the aromatic nucleus can be substituted or unsubstituted. Examples of useful p-phenylenediamine color developing agents include:

N-N-diethyl-p-phenylenediaminemonohydrochloride,
4-N,N-diethyl-2-methylphenylenediamine monohydrochloride,
4-(N-ethyl-N-2-methanesulfonylaminoethyl)-2-methylphenylenediamine sesquisulfate monohydrate,
4-(N-ethyl-N-2-hydroxyethyl)-2-methylphenylenediamine sulfate,
4-N,N-diethyl-2,2'-methanesulfonylaminoethylphenylenediamine hydrochloride,
and the like.

In addition to the primary aromatic amino color developing agent, color developing solutions typically contain a variety of other agents such as alkalies to control pH, bromides, iodides, benzyl alcohol, anti-oxidants, anti-foggants, solubilizing agents, brightening agents, and so forth.

Photographic color developing compositions are employed in the form of aqueous alkaline working solutions having a pH of above 7 and most typically in the range of from about 9 to about 13. To provide the necessary pH, they contain one or more of the well known and widely used pH buffering agents, such as the alkali metal carbonates or phosphates. Potassium carbonate is especially useful as a pH buffering agent.

The fixing bath converts all silver halide into soluble silver complexes which diffuse out of the emulsion layers. Fixing bath retained within the layers of the photographic element is removed in a subsequent water washing step. Thiosulfates, including ammonium thiosulfate and alkali metal thiosulfates such as sodium thiosulfate and potassium thiosulfate, are particularly useful as fixing agents. Other components of the fixing bath include preservatives and sequestering agents.

A commercially important process intended for use with color negative photographic elements which contain the couplers in the silver halide emulsion layers, or in layers contiguous thereto, utilizes, in order, the following processing baths: color developer, wash, bleach, fix, wash and stabilizer. In accordance with this invention, such a process is carried out without the use of a stabilizing bath by incorporating a formaldehyde precursor in the bleaching bath.

A commercially important process intended for use with color reversal photographic elements which contain the couplers in the silver halide emulsion layers, or in layers contiguous thereto, utilizes, in order, the following processing baths: first developer, wash, reversal bath, color developer, bleach, fix, wash and stabilizer. In this process, the first developer reduces the exposed silver halide to metallic silver; the reversal bath nucleates the silver halide that remains after first development, the color developer converts the nucleated silver halide to metallic silver and forms the dye images, the bleach converts all metallic silver to silver halide, the fix converts the silver halide into soluble silver complexes that are washed from the element, and the stabilizing bath improves image dye stability. In accordance with this invention, such a process is carried out without the use of a stabilizing bath by incorporating a formaldehyde precursor in the bleaching bath.

In one particularly advantageous form of the aforesaid color reversal process, a bleach-accelerating bath is employed between the color developing bath and the bleaching bath. Such a bleach-accelerating bath is also referred to in the photographic field as a "conditioning bath". It is used to "condition" the metallic silver, developed in the first and color developers, for complete oxidation to silver halide and to help preserve the acidity of the bleach solution by reducing carryover of color developer into the bleach. The conditioning bath contains, as an essential ingredient, an effective amount of a bleach-accelerating agent. This agent is imbibed into the emulsion layers of the photographic element during treatment with the conditioning bath and, accordingly, is present to exert its beneficial influence in situ when the photographic element enters the subsequent bleach bath.

A wide variety of effective bleach-accelerating agents are well known in the art of photographic color processing. Examples of particularly effective bleach-accelerating agents include aliphatic thiols, heterocyclic thiols, disulfides, thioethers, and persulfates. References describing specific agents which exhibit very effective bleach-accelerating capabilities include British Patent No. 1,138,842 published Jan. 1, 1969 and U.S. Pat. No. 3,893,858 issued July 8, 1975.

In the aforesaid color reversal process, the first developer contains a black-and-white developing agent or a mixture of such developing agents. Useful developing agents include dihydroxybenzene developing agents such as hydroquinone, 3-pyrazolidone developing agents such as 1-phenyl-3-pyrazolidone, and aminophenol developing agents such as para-aminophenol. In addition to the developing agent, the first developer typically contains other agents such as preservatives, sequestering agents, restrainers, antifoggants, buffers and silver halide solvents. The reversal bath contains a nucleating agent, usually a boron compound or a chelated stannous salt that functions as a reducing agent, as well as antioxidants, buffers, fungicides and sequestering agents.

The novel bleaching compositions of the present invention can be utilized with any of a wide variety of photographic elements. For a detailed description of useful photographic elements and methods for their manufacture, reference can be made to Research Disclosure, Item 17643, Vol. 176, Dec., 1978, published by Industrial Opportunities Ltd., Homewell, Havant Hampshire, P09 1EF, United Kingdom.

The photosensitive layers present in the photographic elements processed with the novel bleaching compositions of this invention can contain any of the conventional silver halides as the photosensitive material, for example, silver chloride, silver bromide, silver bromoiodide, silver chlorobromide, silver chloroiodide, silver chlorobromoiodide, and mixtures thereof. These layers can contain conventional addenda and be coated on any of the photographic supports, such as, for example, cellulose nitrate film, cellulose acetate film, polyvinyl acetal film, polycarbonate film, polystyrene film, polyethylene terephthalate film, polymer-coated paper, and the like.

By the term "formaldehyde precursor", as used herein, is meant any compound capable of establishing, in the bleaching solution, an equilibrium relationship between it and formaldehyde. While applicants are not certain of the mechanism whereby their invention functions, it is believed that the precursor acts, in effect, as a formaldehyde donor which gradually releases formaldehyde into the solution at the same rate it is used up in the dye-stabilizing reaction to thereby maintain the equilibrium relationship. Thus, the concentration of formaldehyde in the bleaching solution is always at a very low level and there is not enough formaldehyde in the solution to result in a build-up of undesirably high concentrations in the air above the solution.

Formaldehyde precursors which are especially useful for the purpose of this invention include the water-soluble N-methylol compounds. As used herein, the term "N-methylol compound" refers to a compound having at least one methylol group attached directly to a nitrogen atom. Particularly preferred for the purpose of this invention are N-methylol compounds represented by formulae I, II or III as follows:

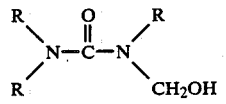
I.

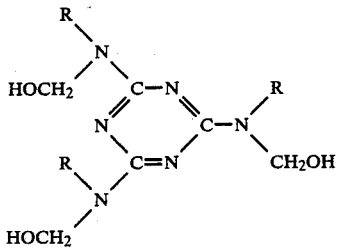
II.

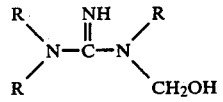
III.

wherein R is a hydrogen atom or a methylol group.

Illustrative examples of particularly preferred N-methylol compounds for the purpose of this invention include:

dimethylol urea
trimethylol urea
dimethylol guanidine
trimethyol melamine
tetramethylol melamine
pentamethylol melamine
hexamethylol melamine
and the like.

Yet another particularly preferred N-methylol compound is 1,3-dimethylol-5,5-dimethyl hydantoin.

In addition to the N-methylol compounds, examples of especially effective formaldehyde precursors include sodium formaldehyde bisulfite and hexamethylenetetramine.

Incorporation of a formaldehyde precursor in a conditioning bath is disclosed in copending commonly assigned U.S. patent application Ser. No. 286,005 filed Dec. 19, 1988, entitled, "Bleach-Accelerating Compositions Containing A Dye-Stabilizing Agent And Use Thereof In Photographic Color Processing", by A. M. Cullinan and P. A. Schwartz.

The invention is further illustrated by the following examples of its practice.

EXAMPLES 1–4

Four different bleaching baths within the scope of this invention were prepared as follows:

| | grams/liter |
|---|---|
| Bath A | |
| Ferric ammonium EDTA | 124 |
| Ammonium bromide | 64 |
| EDTA | 3 |
| Potassium nitrate | 25 |
| Sodium formaldehyde bisulfite | 8.84 |
| Water to one liter | |
| Bath B | |
| Ferric ammonium EDTA | 124 |
| Ammonium bromide | 64 |
| EDTA | 3 |
| Potassium nitrate | 25 |
| Dimethylolurea | 3.96 |
| Water to one liter | |
| Bath C | |
| Ferric ammonium EDTA | 124 |
| Ammonium bromide | 64 |
| EDTA | 3 |
| Potassium nitrate | 25 |
| 1,3-Dimethylol-5,5-dimethylhydantoin | 6.82 |
| Water to one liter | |
| Bath D | |
| Ferric ammonium EDTA | 124 |
| Ammonium bromide | 64 |
| EDTA | 3 |
| Potassium nitrate | 25 |
| Hexamethylenetetramine | 3.08 |
| Water to one liter | |

The above-described bleaching baths were evaluated in the processing of a conventional color reversal photographic film. This film contained a 1-aryl-5-pyrazolone magenta coupler of the formula:

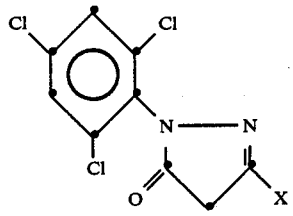

where X represents:

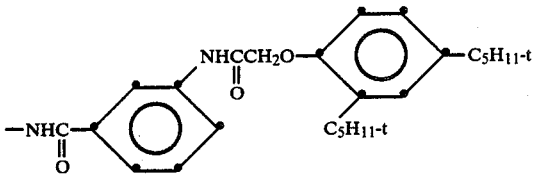

The 1-aryl-5-pyrazolone magenta couplers are believed to react with formaldehyde in accordance with the following equation:

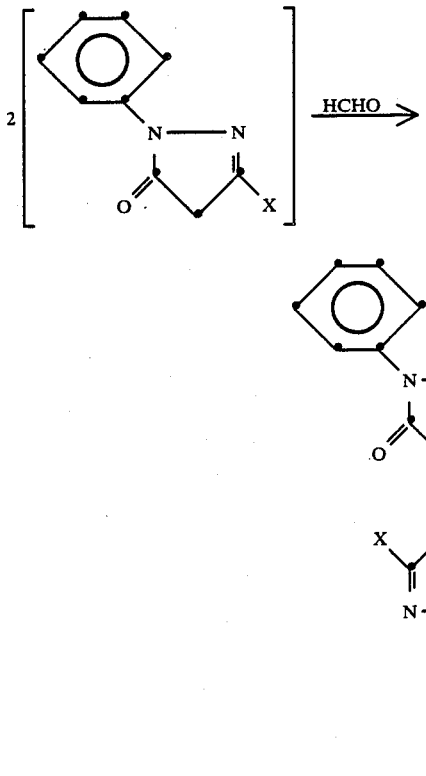

Reaction of the magenta coupler with formaldehyde prevents it from reacting with the magenta dye formed by color development.

The color reversal film was processed in Control Test 1 using a conventional color reversal process employing the following processing times:

| | |
|---|---|
| First Developer | 6 min. |
| Wash | 2 min. |
| Reversal Bath | 2 min. |
| Color Developer | 6 min. |
| Conditioner | 2 min. |
| Bleach | 6 min. |
| Fixer | 4 min. |
| Wash | 4 min. |
| Stabilizer | 30 sec. |
| Dry | @63° C. |

In this process, the stabilizing bath was an aqueous bath containing formaldehyde and a wetting agent.

In Control Test 2, the film was processed in the same manner described above except that the stabilizer was omitted. In each of examples 1 to 4, the stabilizer was omitted and the bleach bath utilized was Bath A, Bath B, Bath C and Bath D, respectively.

For Control Test 1, measurement was made of the amount of formaldehyde in the vapor in equilibrium with the stabilizer bath. For Examples 1 to 4, measurement was made of the amount of formaldehyde in the vapor in equilibrium with the bleach bath. For each of Control Tests 1 and 2 and Examples 1 to 4, measurements were made of (1) the amount of residual unreacted magenta coupler in the film as measured by liquid chromatography and (2) the percentage change in green density at the 1.0 density level after three days at 77° C.

The results obtained are reported in Table I below.

TABLE I

| Test | % Unreacted Coupler | Percentage Change in Green Density | Formaldehyde in Vapor (μg/500 mL)* |
|---|---|---|---|
| Control Test 1 | 0 | −2 | 71.9 |
| Control Test 2 | 100 | −27 | — |
| Example 1 | 12 | −14 | <3.6 |
| Example 2 | 18 | −2 | <3.6 |
| Example 3 | 7 | −5 | <3.6 |
| Example 4 | 12 | −2 | <3.6 |

*3.6 μg/500 mL represents the detection limit.

As indicated by these data, in Control Test 1 the coupler reacted with formaldehyde so that no unreacted coupler remained and the dye stability was good, but there was an undesirably high concentration of formaldehyde in the vicinity of the processing equipment. When the stabilizing bath was omitted in Control Test 2, the result was freedom from objectionable formaldehyde vapor in the atmosphere, but inadequate magenta dye stability. In each of examples 1 to 4, the presence of objectionable formaldehyde vapor was avoided, yet improvement in dye stability, as compared with Control Test 2, was achieved by use of the formaldehyde precursor in the bleach bath.

The invention has been described in detail with particular reference to preferred embodiments thereof, but it will be understood that variations and modifications can be effected within the spirit and scope of the invention.

We claim:

1. A method for processing a silver halide color photographic element including the steps of treating said element with a color developing bath and with a bleaching/dye-stabilizing bath, wherein said bleaching-/dye-stabilizing bath contains a dye-stabilizing amount of a formaldehyde precursor.

2. A method as claimed in claim 1 wherein said formaldehyde precursor is selected from the group consisting of sodium formaldehyde bisulfite, dimethylolurea, 1,3-dimethylol-5,5-dimethyl hydantoin and hexamethylenetetramine.

3. In a method of photographic color reversal processing in which a photographic element is treated in succession with a first developer, a reversal bath, a color developer, a conditioning bath containing a bleach-accelerating agent, a bleaching bath and a fixing bath; the improvement which comprises incorporating in said bleaching bath a dye-stabilizing amount of a formaldehyde precursor.

4. In a method of photographic color reversal processing in which a photographic element is treated in succession with a first developer, a reversal bath, a color developer, a conditioning bath containing a bleach-accelerating agent, a bleaching bath and a fixing bath; the improvement which comprises incorporating in said bleaching bath a dye-stabilizing amount of hexamethylenetetramine.

* * * * *